US009242280B2

(12) United States Patent
Katzenbächer et al.

(10) Patent No.: US 9,242,280 B2
(45) Date of Patent: Jan. 26, 2016

(54) SYSTEM FOR TREATING AND/OR PROCESSING LIQUID PRODUCTS AND METHOD FOR CLEANING COMPONENTS OF SUCH SYSTEMS

(75) Inventors: Hans-Jürgen Katzenbächer, Bad Kreuznach (DE); Anne Bidinger, Bad Krueznach (DE); Michael Breil, Andernach (DE)

(73) Assignee: KHS GmbH, Dortmund (DE)

( * ) Notice: Subject to any disclaimer, the term of this patent is extended or adjusted under 35 U.S.C. 154(b) by 497 days.

(21) Appl. No.: 13/255,361

(22) PCT Filed: Jul. 14, 2010

(86) PCT No.: PCT/EP2010/004268

§ 371 (c)(1),
(2), (4) Date: Sep. 8, 2011

(87) PCT Pub. No.: WO2011/009546

PCT Pub. Date: Jan. 27, 2011

(65) Prior Publication Data

US 2012/0000492 A1 Jan. 5, 2012

(30) Foreign Application Priority Data

Jul. 24, 2009 (DE) ..... 10 2009 034 693

(51) Int. Cl.

| | |
|---|---|
| ***B08B 9/02*** | (2006.01) |
| ***B08B 9/08*** | (2006.01) |
| ***B67C 3/00*** | (2006.01) |

(52) U.S. Cl.

CPC ... *B08B 9/02* (2013.01); *B08B 9/08* (2013.01); *B67C 3/001* (2013.01)

(58) Field of Classification Search

CPC ..... A01J 7/022; B08B 9/08; B08B 2209/00; B08B 2209/027; B08B 2209/032; B08B 2209/08

USPC ..... 134/103.1, 104.1, 166 R, 167 R, 168 R, 134/168 C, 167 C, 169 R, 169 A, 169 C, 171, 134/166 C

See application file for complete search history.

(56) References Cited

U.S. PATENT DOCUMENTS 3,140,828 A * 7/1964 Gaianor ..... 239/227
3,435,834 A * 4/1969 Cooper ..... 134/98.1

(Continued)

FOREIGN PATENT DOCUMENTS

DE 1557552 4/1970
DE 2106223 8/1972

(Continued)

OTHER PUBLICATIONS

Manger: CIP-Anlagen: Stapelreinigung oder verlorene Reinigung ?. In: Brauwelt, 2006, Nr. 21, S. 606-611 (Machine Translation of Abstract).

(Continued)

*Primary Examiner* — David Cormier
(74) *Attorney, Agent, or Firm* — Occhiuti & Rohlicek LLP

(57) ABSTRACT

System for treating and/or processing liquid products, in particular beverages, having at least two system components, having a cleaning and rinsing system for cleaning and rinsing of at least product-carrying regions of the system components with at least one liquid cleaning and rinsing medium, and having at least one source for providing the cleaning and rinsing medium.

25 Claims, 3 Drawing Sheets

(56) References Cited

U.S. PATENT DOCUMENTS

| | | | | |
|---|---|---|---|---|
| 5,427,126 | A | 6/1995 | Carney et al. | |
| 5,603,826 | A * | 2/1997 | Welch | 210/195.1 |
| 6,767,408 | B2 * | 7/2004 | Kenowski et al. | 134/18 |

FOREIGN PATENT DOCUMENTS

| | | |
|---|---|---|
| DE | 2714083 | 10/1978 |
| DE | 102009020912 | 11/2010 |
| EP | 0260649 | 3/1988 |
| EP | 0260649 | 3/1992 |
| GB | 1121616 | 7/1968 |
| WO | 2010/130331 | 11/2010 |

OTHER PUBLICATIONS

Manger: CIP-Anlagen: Stapelreiatigung oder verlorene Reinigung ?. In: Brauwelt, 2006, Nr. 21, S. 606-611 (Machine Translation of Abstract).

* cited by examiner

SYSTEM FOR TREATING AND/OR PROCESSING LIQUID PRODUCTS AND METHOD FOR CLEANING COMPONENTS OF SUCH SYSTEMS

CROSS-REFERENCE TO RELATED APPLICATIONS

This application is the National Stage of International Application No. PCT/EP2010/004268, filed on Jul. 14, 2010, which claims the benefit of the priority date of German Patent Application No. 10 2009 034 693.7, filed on Jul. 24, 2009. The contents of both applications are hereby incorporated by reference in their entirety.

FIELD OF INVENTION

The invention relates to processing liquid products, cleaning and specifically to cleaning system components and connections between system components, i.e. in particular for cleaning product-carrying chambers and channels of the system components and product-carrying lines between these components, including in a CIP cleaning mode.

BACKGROUND

Known cleaning and rinsing systems are configured such that, during cleaning, all the system components, with their regions to be cleaned, and all the product-carrying connections and lines between the system components are arranged in series and thus form a single CIP circuit through which the cleaning medium flows. This design means that every volume element of the cleaning or rinsing media invariably passes through all the system components and all the connections and lines.

It is customary to use different cleaning media during the cleaning mode. Examples of such cleaning media include hot water, acid, alkaline solution and fresh water. In such cases, the system components arranged in series in the CIP circuit are treated in temporal succession with these cleaning media.

A disadvantage of known cleaning systems thereof is that it takes a long time to carry out the cleaning. This is in part because the total cleaning time depends on the cleaning time for whichever system component takes the longest to clean. In addition, all the system components are treated with all the cleaning media, even thought it might improve cleaning quality or reduce cleaning time to clean different system components in different ways.

In practice, therefore, the cleaning duration is generally determined by the cleaning duration of the container filling machine since this must be cleaned in a particularly intensive manner due to its numerous small and angled liquid channels and the similar valve arrangements. Cleaning the container filling machine therefore takes a long time.

In known systems, it is also highly disadvantageous that all the system components arranged in series must be fully prepared for the subsequent cleaning process before the latter can start. The preparation of the container filling machine is particularly laborious, because each filling point must be provided with a rinsing cap or rinsing sleeve.

SUMMARY

The problem addressed by the invention is that of providing considerably improved cleaning system for system components of a filling system.

In one aspect, the invention includes an apparatus for processing liquid products. Such an apparatus includes first and second system components, a first-system-component first valve unit, a first-system-component second valve unit, a second-system-component first valve unit, a second-system-component second valve unit, and a treatment system for cleaning or rinsing product-carrying regions of the first and second system components. The treatment system includes a first circuit having a first ring line, and a first source for providing a first treatment medium, which is a liquid cleaning-or-rinsing medium. The first ring line connects to the first source so that the first treatment medium traverses a path along the first ring line. The first circuit begins and ends at respective first and second points, both of which are at the first source. The first-system-component first valve unit, which is on the first ring line, enables controlled tapping of the first treatment medium for treating the first system component from the first ring line, and the second-system-component first valve unit, which is on the first ring line, enables controlled tapping of the first treatment medium for treating the second system component from the first ring line. The first-system-component second valve unit, which is on the first ring line, enables controlled feeding back of the first treatment medium to the first ring line after the first treatment medium has been used to treat the first system component, and the second-system-component second valve unit, which is on the first ring line, enables controlled feeding back of the first treatment medium to the first ring line after the first treatment medium has been used to treat the second system component. The second-system-component second valve unit is downstream from the second-system-component first valve unit along the first circuit and the first-system-component second valve unit is downstream from the first-system-component first valve unit along the first ring line. The first-system-component first valve unit and the first-system-component second valve unit are configured such that the first circuit remains uninterrupted in a course between the first-system-component first valve unit and the first-system-component second valve unit during tapping and feeding-back of the first treatment medium. The second-system-component first valve unit and the second-system-component second valve unit are configured such that the first circuit remains uninterrupted in a course between the second-system-component first valve unit and the second-system-component second valve unit during tapping and feeding back of the first treatment medium.

In some embodiments, the treatment system includes a second circuit that has a second source for supplying a second treatment medium, a second ring line that carries the second treatment medium, a second-circuit first valve unit, and a second-circuit second valve unit. This second system circuit is independent of the first system circuit and is configured to tap the second ring line in a controlled manner for the second treatment medium. Among these embodiments are those in which the second-circuit first valve unit is arranged upstream from the second-circuit second valve unit in relation to a flow direction of the second treatment medium in the second circuit. Also among these embodiments are those that include a control device for individually controlling the second-circuit first valve unit, the second-circuit second valve unit, the first-system-component first valve unit, the first-system-component second valve unit, the second-system-component first valve unit, and the second-system-component second valve unit to enable the first system component to be treated with the first medium and to enable the second system component to be concurrently treated with the second medium. In some of these embodiments, the wherein the first treatment medium and the second treatment medium are different, whereas in others, they are the same.

In some embodiments, the treatment system includes a second circuit that has a second source for supplying a second treatment medium, a second ring line that carries the second treatment medium, a second-circuit first valve unit, a second-circuit second valve unit, and a cleaning-media separator for ensuring separation of the first and second cleaning media in component-side treatment paths. This second system circuit is independent of the first system circuit and is configured to tap the second ring line in a controlled manner for the second treatment medium. Among these embodiments are those in which a cleaning media separator includes a control device, and a sensor, the sensor being arranged to detect a property of treatment medium to be fed back from the first system component, and the control device receiving information from the sensor and, based at least in part on the information, controlling the first-system-component second valve unit to cause treatment medium from the first system component to be fed back into the first ring line. In some of these embodiments, there is also a treatment path return pipe in which the sensor is arranged.

Other embodiments include a first feed pipe, a second feed pipe, a first return pipe, a second return pipe, a first treatment path, and a second treatment path, the first feed pipe and second feed pipes being parts of respective first and second treatment paths. The first return pipe is part of the first treatment path, and the second return pipe is part of the second treatment path. The first treatment path passes through the first system component, thereby enabling a first selected treatment medium to flow during treatment of the first system component, and the second treatment path passes through the second system component, thereby enabling a second selected treatment medium to flow during treatment of the second system component. The first feed pipe taps off the first selected treatment medium, and the second feed pipe taps off the second selected treatment medium. The first return pipe returns the first selected treatment medium, and the second return pipe returns the second selected treatment medium. In some of these embodiments, the first selected treatment medium and the second the first selected treatment medium are different, whereas in others, they are the same.

Embodiments include those in which the first source includes a tank that contains an acid solution, those in which the first source includes a tank that contains an alkaline solution, those in which first source includes a tank that contains water, and those in which the first source includes a tank that contains heated water.

Also among the embodiments are those that include treatment path feed pipes, treatment path return pipes, a first valve module, a second valve module, a first line, and a further source that contains water containing added disinfectant. The treatment path feed pipes and the treatment path return pipes are connected via the first and second valve modules to the first line. Meanwhile, the first line is connected to the further source for enabling controlled tapping off and feeding back of the water containing the added disinfectant. In some of these embodiments, the first line, which is the line that is connected to the further source leads, to a drain.

Yet other embodiments have a control device for controlling the first-system-component first valve unit and the first-system-component second valve unit to cause treatment medium fed to the first system component to be fed back to the first system circuit via the first-system-component second valve unit.

Also among the embodiments are those with a sensor, including those with a sensor for monitoring a type of treatment medium, and those with a sensor for monitoring a quality of treatment medium.

Additional embodiments include those with a heating element for heating treatment medium in either the first system circuit or the first ring line.

Further embodiments include those in which the first system component includes a filling machine for bottling beverages into containers, those in which the first system component includes a buffer store or tank, those in which the first system component includes a flash pasteurizing unit, and those in which the first system component includes a mixer unit.

One feature of the invention lies in the fact that the cleaning system, for at least one cleaning medium, has a closed system circuit that is formed by at least one ring line and in which the source providing the cleaning medium is also arranged.

The system components can be connected to this system circuit by a cleaning or rinsing path feed pipe of their respective cleaning path and by a cleaning or rinsing path return pipe of their respective cleaning path, via valve devices, namely without interrupting the system circuit, i.e. in such a way that the cleaning path through the system component in question lies parallel to that part of the system circuit that extends between the cleaning or rinsing path feed pipe and the cleaning or rinsing path return pipe and through which the cleaning medium flows. In order to clean and rinse the system components, therefore, the cleaning medium is tapped off in sufficient quantity from the system circuit and is fed back to the latter. The ring lines forming the system circuits lead to all the system components for which cleaning is required.

As a result, it is possible, even when there are a plurality of system circuits or ring lines provided separately for different cleaning media, to treat different system components at the same time in a temporally overlapping manner, and/or in a temporally offset manner with identical or different cleaning media during the cleaning mode, and/or to select the treatment duration of each system component in a manner that is optimal for that component and different from the treatment duration of other system components.

It is also now possible to treat the system components in an optimized sequence and using optimized methods so that the downtime of the system as a whole is considerably reduced. For example, it is particularly advantageous if the operating staff first prepares the system component with the longest treatment duration, for example the filling machine, and starts with the cleaning of this system component. By virtue of this procedure, the work required to prepare the further system components is carried out in parallel with the already ongoing process of cleaning the system component that takes the longest time to clean. This ultimately leads to reduced downtime.

To ensure that the cleaning medium supplied to the respective system component is also fed back to the system circuit carrying this cleaning medium or to the corresponding ring lines so that no or substantially no mixing of different cleaning media takes place, each system component is configured with its own cleaning media separation.

A wide range of different cleaning methods is possible using the cleaning system. These include product-specific cleaning methods and methods that are specially adapted to the product processed in the system. Besides conventional cleaning methods, it is also possible to carry out methods that use heated alkaline solution, alkaline solution, and/or acid to which a disinfectant has been added and that has been warmed for example, wherein, for different products, in particular also for different beverages, there is no need for hot water sterilization, namely when use is made of hot alkaline solution or warm alkaline solution containing disinfectant. In this case, it may be necessary to finish the cleaning process using prepared water, such as water containing added disinfectant, in order to achieve the necessary level of hygiene of the system after cleaning.

In the context of the invention, the term "system components" includes all the components or devices of a system for which cleaning and/or rinsing is required, in particular those components or devices that are used to provide, prepare and/or process the respective product during normal operation of the system. In this context, system components include components for mixing different product components, for carbonating or adding $CO_2$ to products, for briefly heating or pasteurizing products (including flash pasteurizing units), buffer stores for the intermediate storage of products, and filling machines.

As used herein, "cleaning" and its variants refer to cleaning, rinsing, and treating, or any combination thereof, as well as variants thereof.

As used herein, "medium" refers to a cleaning, treatment, and/or rinsing medium and "media" refers to cleaning, treatment, and/or rinsing media.

As used herein, "upstream" and "downstream" are given relative to a flow direction, generally designated as "A." More precisely, a flow direction defines a flow vector, and a second point is deemed to be downstream of a first point if a vector from said first point to said second point is in the same direction as the flow vector.

Further developments, advantages and possible uses of the invention will also become apparent from the following description of examples of embodiments and from the figures. All the features described and/or shown form in principle, per se or in any combination, the subject matter of the invention, regardless of the way in which they are combined in the claims or the way in which they refer back to one another. The content of the claims is also included as part of the description.

BRIEF DESCRIPTION OF THE DRAWINGS

These and other features of the invention will be apparent from the following detailed description and the accompanying figures in which.

DETAILED DESCRIPTION

Figure 1:
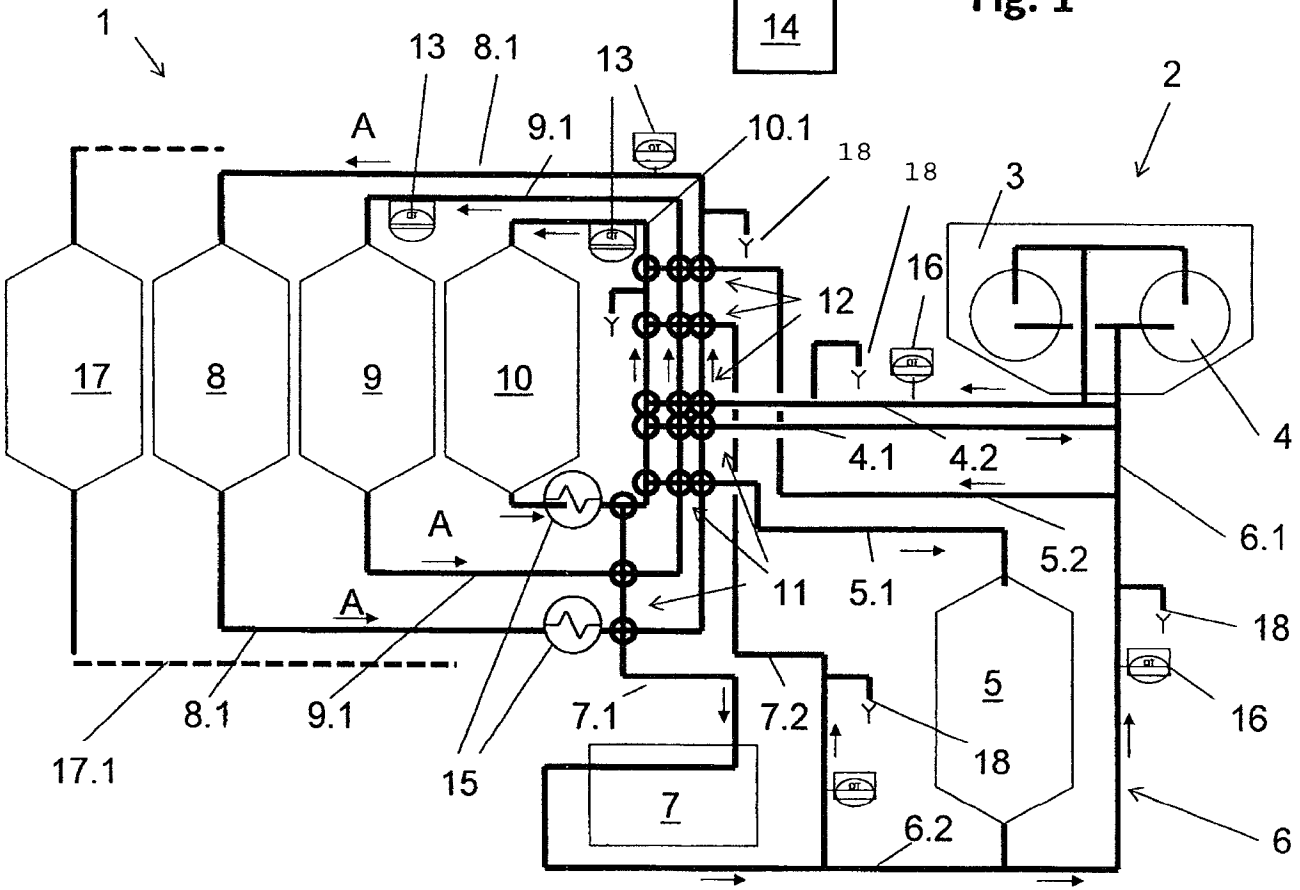
FIG. 1 shows a schematic functional diagram of a first embodiment of a cleaning system for cleaning a filling machine that fills containers with liquid product.

FIG. 1 shows a first embodiment 1 having a filling machine 2 for filling liquid filling product into containers. The filling machine 2 has a rotor 3 and a product vessel or ring-shaped vessel 4 provided on the rotor 3. During the filling mode, the product vessel 4 is at least partially filled with the liquid filling product.

The first embodiment 1 also has a buffer tank 5 that is connected to the filling machine 2 via a product line 6. During filling mode, the buffer tank 5 holds a buffer quantity of the product. This ensures a continuous Inflow of product to the filling machine 2 or to the filling product vessel 4 thereof and thus a continuous filling mode.

The first embodiment 1 also has a flash pasteurizing unit 7 for pasteurizing the product. The flash pasteurizing unit 7 briefly heats the product to sterilize it, and then cools the product in an internal circuit. The product line 6 connects the flash pasteurizing unit 7 to the buffer tank 5 and to the filling machine 2. The product is fed to the flash pasteurizing unit 7 via another product line from a device for providing the product, for example from a reservoir or a mixing unit.

The first embodiment 1 also comprises a cleaning system for cleaning system components. This includes cleaning all the product-carrying chambers, channels and lines.

In the illustrated embodiment, the cleaning system includes first, second, and third cleaning-medium tanks 8, 9, 10. Each cleaning-medium tank 8, 9, 10 holds a particular liquid cleaning medium. The first cleaning-medium tank 8 holds alkaline solution; the second cleaning-medium tank 9 holds acid solution, and the third cleaning-medium tank 10 holds hot water. Each tank 8, 9, 10 is part of a separate system circuit that is formed by corresponding first, second, and third ring lines 8.1, 9.1, 10.1 that are fed back from a lower outlet of the corresponding cleaning-medium tank 8, 9, 10 to an upper inlet of that cleaning-medium tank 8, 9, 10.

In detail, the first ring line 8.1 and its assigned first cleaning-medium tank 8 define a first system circuit; the second ring line 9.1 and its assigned second cleaning-medium tank 9 define a second system circuit; and the third ring line 10.1 and its assigned third cleaning-medium tank 10 define a third system circuit. Each ring line 8.1, 9.1, 10.1 includes a circulating pump to circulate a corresponding cleaning medium in a flow direction.

Also provided along the ring lines 8.1, 9.1, 10.1 are first and second controllable valve units 11, 12. The second controllable valve unit 12 is downstream from the first controllable valve unit 11. The first and second controllable valve units 11, 12 individually control cleaning of the system components with the different cleaning media from the first, second, and third cleaning-medium tank 8, 9, 10.

Details of the control are described below. In particular, control is exercised such that different system components are treated with different cleaning media either at the same time or in a temporally overlapping manner.

Each system component is assigned a corresponding first controllable valve unit 11 and a corresponding second controllable valve unit 12. In the illustrated example, the system components include the filler 2, the buffer tank 5 and the flash pasteurizing unit 7.

Provided in the ring lines 8.1, 9.1, 10.1 downstream from the first controllable valve unit 11 and second controllable valve unit 12 and upstream from the inlet into the respective cleaning-medium tanks 8, 9, 10 are first sensors 13. These first sensors 13 supply measurement signals to a central control unit 14. The first sensors 13 and the central control unit 14 cooperate to monitor the type of cleaning medium fed back to a cleaning-medium tank 8, 9, 10.

The control unit 14 controls the first and second controllable valve units 11, 12 in such a way that the only cleaning medium that is fed back to a particular cleaning-medium tank 8, 9, 10 is the cleaning medium that is assigned to that cleaning-medium tank. In particular, only alkaline solution is fed back into the first cleaning-medium tank 8; only acid is fed back to the second cleaning-medium tank 9; and only water is fed back to the third cleaning-medium tank 10. Also provided in the first and third ring lines 8.1, 10.1 upstream from the first valve unit 11 is a heating device 15 for heating the alkaline solution and the hot water.

For rinsing in the closed circuit, the system components, namely the filling machine 2 or the product vessel 4 thereof, the buffer store 5 and the flash pasteurizing unit 7, are each connected by a rinsing line feed pipe to the first controllable valve units 11 and by a rinsing line return pipe to the second controllable valve units 12. In particular:

- the product vessel 4 is connected by a first rinsing line feed pipe 4.1 to its associated first controllable valve unit 11 and is connected by a first rinsing line return pipe 4.2 to its associated valve device,
- the buffer store 5 is connected by a second rinsing line feed pipe 5.1 to its associated first controllable valve unit 11 and is connected by a second rinsing line return pipe 5.2 to its associated second controllable valve unit 12, and
- the flash pasteurizing unit is connected by a third rinsing line feed pipe 7.1 to its associated first controllable valve unit 11 and is connected by a third rinsing line return pipe 7.2 to its associated second controllable valve unit 12.

Each of the controllable valve units 11, 12 has at least four switching states. In one switching state, the connection to the connected rinsing line feed pipe or rinsing line return pipe is blocked. In the other three switching states, the respective rinsing line feed pipe assigned to a system component and the rinsing line return pipe assigned to the system component connect to one of the ring lines 8.1, 9.1, 10.1 to tap off a particular cleaning medium and to feed the cleaning medium to whichever cleaning-medium tank 8, 9, 10 is assigned to that cleaning medium.

The rinsing line feed pipes 4.1, 5.1, 7.1 and the associated rinsing line return pipes 4.2, 5.2, 7.2 form the connections of a component-side cleaning path that includes all the chambers, channels, connections, and lines that are to be cleaned on the system component in question. Each of these cleaning paths is assigned means for cleaning media separation, i.e. means that ensure that the cleaning medium fed back from a cleaning path is actually fed back, by appropriate actuation of the second controllable valve units 12, to the ring line 8.1, 9.1, 10.1 assigned to the respective cleaning medium and thus to the correct cleaning-medium tank 8, 9, 10. To achieve this, the illustrated embodiment includes second sensors 16 that are connected to the control device 14. These second sensors 16 are placed along the rinsing line return pipes 4.2, 5.2 and 7.2 to detect the type of cleaning medium flowing back from the system component. Signals from these second sensors 16 trigger an appropriate actuation of the second controllable valve units 12.

In the simplest case, the first and second controllable valve units 11, 12 include three individually controllable diverter valves. Each of these diverter valves connects to a ring line 8.1, 9.1, 10.1, to a rinsing line feed pipe 4.1, 5.1, 7.1, and to a rinsing line return pipe 4.2, 5.2, 7.2 that is to be connected in a controlled manner to the respective ring line 8.1, 9.1, 10.1. The outputs of the three diverter valves forming the respective first and second controllable valve units 11, 12 are connected in parallel to a respective rinsing line feed pipe 4.1, 5.1, 7.1 or rinsing line return pipe 4.2, 5.2, 7.2.

As shown in FIG. 1, the rinsing line feed pipes 4.1, 5.1, 7.1 and the rinsing line return pipes 4.2, 5.2, 7.2 also include significant portions of the product line 6. As a result, these portions can also be automatically cleaned during the cleaning of the system components. In the illustrated embodiment, this applies with the exception of first and second product-pipe portions 6.1, 6.2 in FIG. 1. However, the first and second product-pipe portions 6.1, 6.2 can nevertheless likewise be cleaned with the respective cleaning medium by appropriate actuation of the first and second controllable valve units 11, 12.

In addition to the possibility of cleaning the system components with alkaline solution, acid and hot water, the first embodiment 1 includes a water tank 17 to permit a final rinsing with fresh water. In this case, the first and second controllable valve units 11, 12 have an additional switching function or an additional valve that makes it possible to rinse the system components with fresh water via the individual component-side cleaning paths and to divert the fresh water into a channel system or a fresh water preparation system.

Each rinsing line return pipe 4.2, 5.2 and 7.2 has an outlet valve or a drain valve 18 for drainage thereof.

A wide range of cleaning or rinsing methods is possible depending on the filling product. These methods conform to cleaning programs that are stored in a product-related manner in a memory of the control device 14. Possible cleaning methods include conventional cleaning, hot cleaning, and cold cleaning.

Conventional cleaning includes: pre-rinsing with water; treatment with hot alkaline solution at approximately 85° C.; intermediate rinsing with warm or hot water; treating with acid; rinsing with hot water; and subsequently rinsing with fresh water.

Hot cleaning includes: rinsing with hot alkaline solution at approximately 85° C.; subsequent rinsing with cold water; treatment with acid which optionally contains added disinfectant; and subsequent rinsing with fresh water that optionally contains added disinfectant, e.g. $ClO_2$. The cold water rinse and acid treatment can be carried out multiple times.

Cold cleaning includes: treatment with alkaline solution, for example with heated alkaline solution at approximately 40° C. containing added disinfectant and an activator; intermediate rinsing with cold water; treatment with acid and disinfectant; and subsequent rinsing with fresh water optionally containing added disinfectant, e.g. $ClO_2$.

The intermediate rinsing and acid treatment steps can be carried out multiple times.

Figure 2:
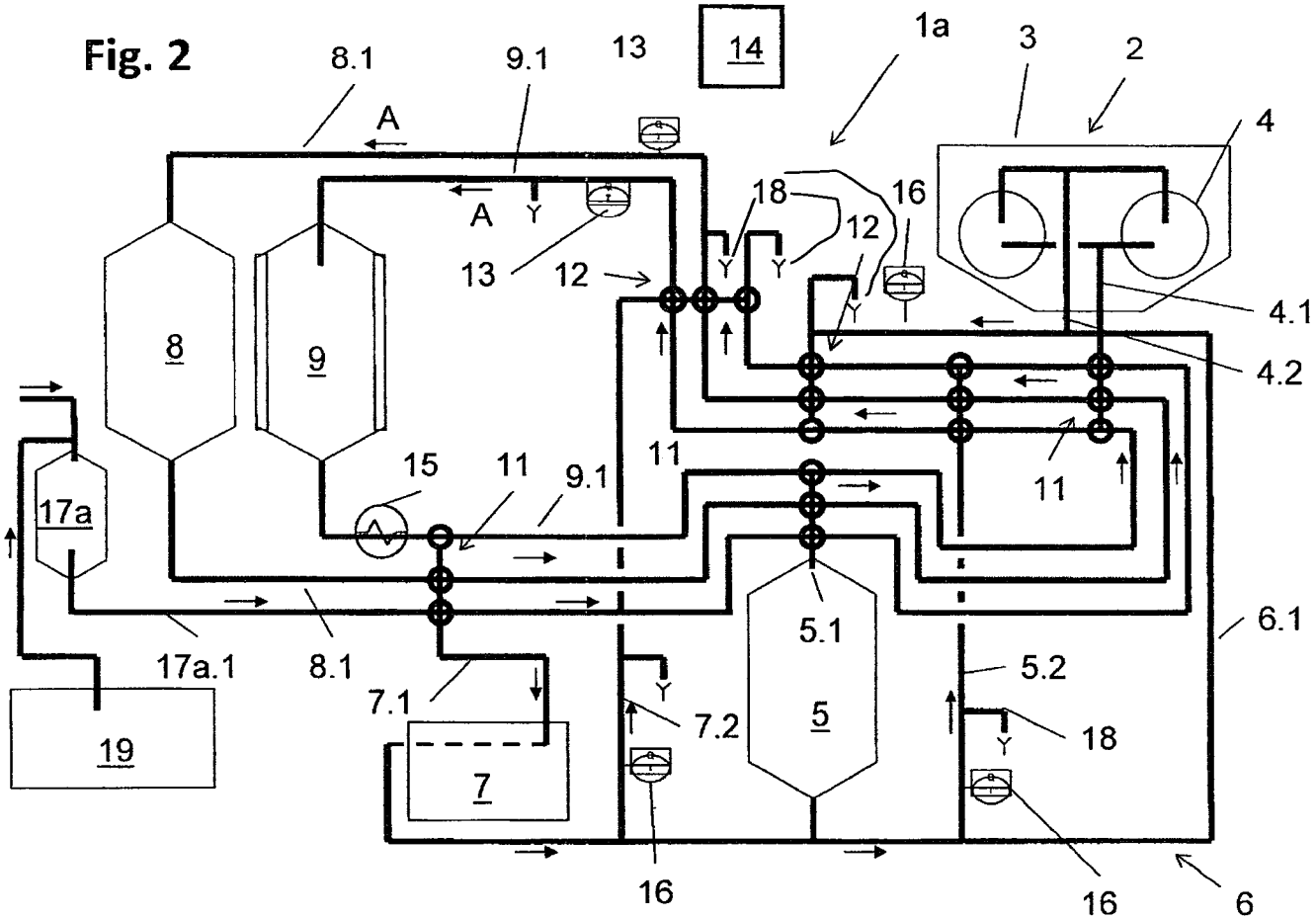
FIG. 2 shows a schematic functional diagram of a second embodiment of a cleaning system for cleaning a filling machine that fills containers with liquid product.

FIG. 2 shows a second embodiment 1*a* that is particularly suitable for the bottling of beer and beer-based mixed beverages. The second embodiment 1*a* comprises the same system components that were present in the first embodiment 1, namely the filling machine 2, the buffer tank 5, and the flash pasteurizing unit 7. However, the second embodiment 1*a* has a cleaning system that differs from that of the first embodiment 1.

Specifically, in the second embodiment 1, the cleaning system omits the third cleaning-medium tank 10 and the third ring line 10.1 assigned to the third cleaning-medium tank 10. Additionally, the cleaning system replaces the water tank 17 with a buffer tank 17*a* that is connected to a source for supplying the fresh water. An activator 19 assigned to the buffer tank 17*a* mixes a disinfectant, such as $ClO_2$into the fresh water.

The first and second controlled valve units 11, 12 connect to the first and second ring lines 8.1, 9.1 and also to a buffer-tank line 17*a* connected to the buffer tank 17*a*. They do so in such a way that the first controlled valve units 11 are upstream from the second controlled valve units 12 in relation to the flow direction A of the cleaning media in the first and second ring lines 8.1, 9.1 and also in relation to the flow direction A of the water provided by the buffer tank 17*a*.

In the design of the system components, namely the filling machine 2, the buffer tank 5, the flash pasteurizing unit 7, the cleaning paths internal to the components which include the chambers, channels, and lines thereof and that extend between the rinsing line feed pipes 4.1, 5.1 and 7.1 and the rinsing line return pipes 4.2, 5.2 and 7.2, the second embodiment 1 corresponds to those in the first embodiment 1. This similarity extends to the aforementioned cleaning methods. However, the various rinsing steps, such as the intermediate rinsing and subsequent rinsing in the examples of possible cleaning methods described above, rely on water from the buffer tank 17*a*.

Figure 3:
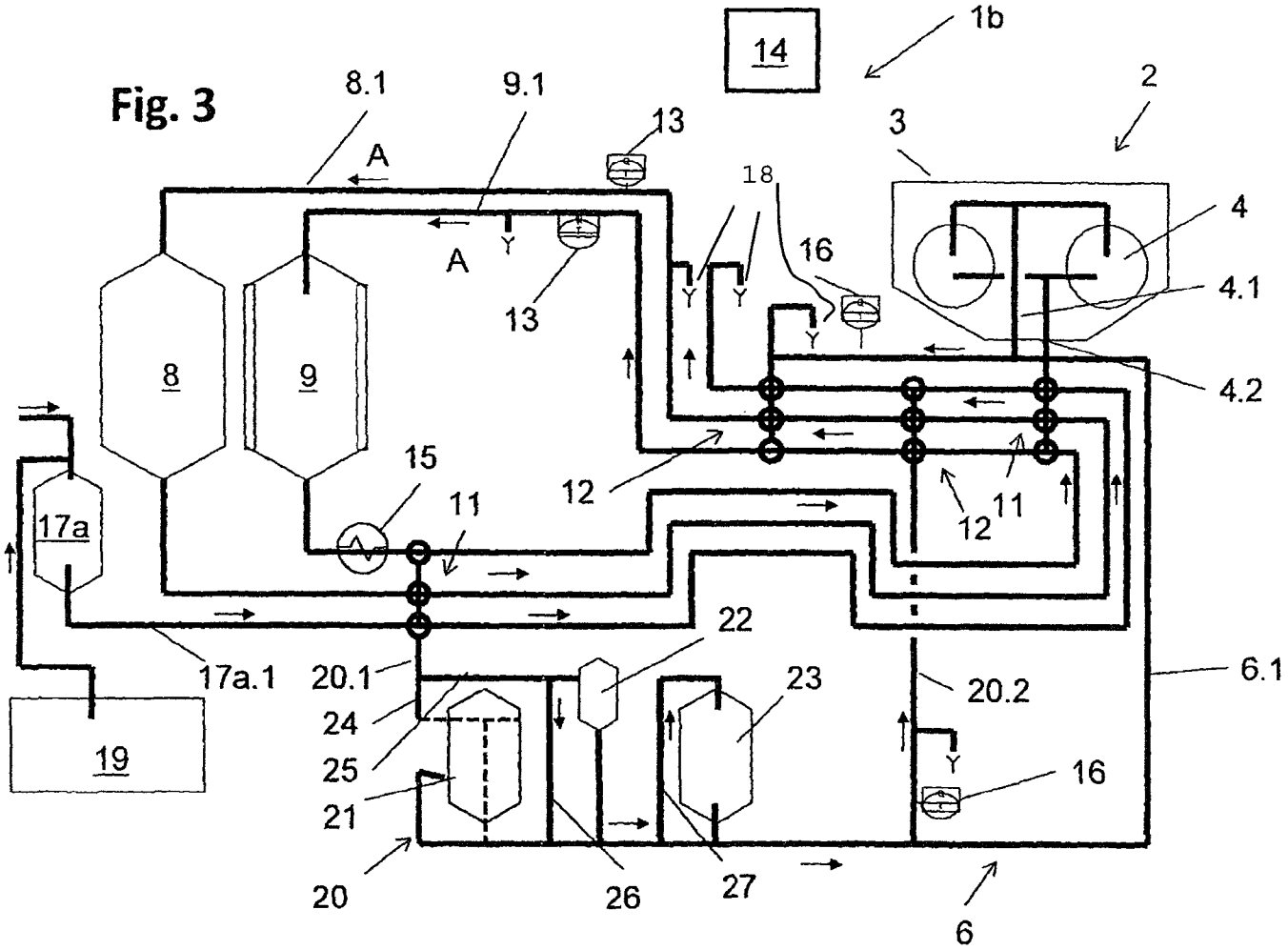
FIG. 3 shows a schematic functional diagram of a third embodiment of a cleaning system for cleaning a filling machine that fills containers with liquid product.

FIG. 3 shows a third embodiment 1*b* that is particularly suitable for bottling carbonated soft drinks.

The third embodiment 1*b* omits the buffer tank 7 and replaces the flash pasteurizing unit 7 with a mixer 20. The mixer 20 supplies the product to be bottled in the filling machine 2 as a mixed product consisting of a main component and an additional component. A typical main component is carbonated water. A typical additional component is a flavoring additive.

The mixer 20 includes a main-component tank 21 for providing the main component, an additional-component tank 22 for providing the additional component, and a buffer tank 23. The main component tank 21, the additional-component tank 22, and the buffer tank 23 connect to a lower outlet and, via control valves, to the product line 6 in which there is also provided a mixing device or mixing section for mixing the main component and the additional component and also optionally for incorporating $CO_2$ into one of the components or into the mixed product.

A fourth rinsing line feed pipe 20.1 provided for cleaning the mixer 20 connects to one of the first controllable valve units 11. First and second branch lines 24, 25 connect upper inlets of the main-component tank 21 and of the additional-component tank 22 to the fourth rinsing line feed pipe 20.1. A third branch line 26 connects the upper connection of the additional-component tank 22 and the product line 6. A fourth branch line 27 connects the upper connection of the buffer tank 23 and the product line 6. The product line 6, which connects to the second controllable valve unit 12, is also part of a fourth rinsing line return pipe of 20.2, which connects to the mixer 20. The fourth rising line return pipe 20.1 includes a sensor 16 for cleaning media separation and a valve 18 for venting or emptying.

Unlike the first embodiment 1, the third embodiment 1*b* has only two first controllable valve units 11 and two second controllable valve units 12. The first controllable valve unit 11 are arrange upstream from the second controllable valve units 12 in the flow direction A of both the cleaning media in the first and second ring lines 8.1, 9.1 and the water in the buffer-tank line 17*a*.1. The first controllable valve units 12 selectively connect the first and fourth rinsing line feed pipes 4.1, 20.1 to the first and second ring lines 8.1, 9.1 and to the buffer-tank line 17*a*.1. The second controllable valve units 12 connect the second and fourth rinsing line return pipes 4.2, 20.2 to the associated first and second ring line 8.1, 9.1 and to the buffer-tank line 17*a*.1 and do so in a controlled manner and as a function of the medium being used.

Regardless of the cleaning medium being used, in order to treat the mixer 20, an associated first controlled valve unit 11 supplies that cleaning medium to the fourth rinsing line feed pipe 20.1. In the process, the cleaning medium flows through the main-component tank 21, through the additional-component tank 22, and also through all the lines and connections of the mixer 20. In particular, the cleaning medium flows through the first branch line 24, the second branch line 25, and the third branch line 26. The cleaning medium also flows to the buffer tank 23 via the fourth branch line 27 before being conveyed away via the fourth rinsing line return pipe 20.2. To optimize cleaning of all components, and in particular, of all product-carrying components of the mixture 20, it is advantageous to control the flow of the cleaning medium by appropriate actuation of control valves provided in the mixer 20.

Carbonated products are kept under pressure in the buffer tank 23 by a $CO_2$ gas buffer. An advantage of the third embodiment 1*b* cleaning of the buffer tank 23 can take place without the use of alkaline solution. Instead, the buffer tank 23 can be cleaned with acid, thus avoiding, without any gas exchange, a hazardous overpressure that would otherwise be generated by a chemical reaction and that might destroy the buffer tank. The same advantage applies to the cleaning of other system components, which may remain filled with $CO_2$ gas during the cleaning. Nevertheless, as a result of the inventive configuration, however, it is still possible to treat system components that do not contain $CO_2$ gas with alkaline solution in a simultaneous or temporally overlapping manner.

The invention has been described above on the basis of examples of embodiments. It will be understood that numerous changes and modifications are possible without thereby departing from the inventive concept on which the invention is based.

The invention claimed is:

1. An apparatus for processing liquid products, said apparatus comprising a first system component, a second system component, a first-system-component first valve unit, a first-system-component second valve unit, a second-system-component first valve unit, a second-system-component second valve unit, and a treatment system for cleaning or rinsing product-carrying regions of said first and second system components, wherein said treatment system comprises a first circuit, wherein said first circuit comprises a first ring line, wherein said first circuit comprises a first source for providing a first treatment medium, wherein said first treatment medium comprises liquid cleaning-or-rinsing medium, wherein said first ring line is connected to said first source, wherein said first treatment medium traverses a path along said first ring line, wherein said first circuit begins at a first point, wherein said first circuit ends at a second point, wherein said first point is at said first source, wherein said second point is at said first source, wherein said first-system-component first valve unit, which is on said first ring line, enables controlled tapping of said first treatment medium for treating said first system component from said first ring line, wherein said second-system-component first valve unit, which is on said first ring line, enables controlled tapping of said first treatment medium for treating said second system component from said first ring line, wherein said first-system-component second valve unit, which is on said first ring line, enables controlled feeding back of said first treatment medium to said first ring line after said first treatment medium has been used to treat said first system component, wherein said second-system-component second valve unit, which is on said first ring line, enables controlled feeding back of said first treatment medium to said first ring line after said first treatment medium has been used to treat said second system component, wherein said second-system-component second valve unit is downstream from said second-system-component first valve unit along said first circuit, wherein said first-system-component second valve unit is downstream from said first-system-component first valve unit along said first ring line, wherein said first-system-component first valve unit and said first-system-component second valve unit are configured such that said first circuit remains uninterrupted in a course between said first-system-component first valve unit and said first-system-component second valve unit during tapping and feeding-back of said first treatment medium, and wherein said second-system-component first valve unit and said second-system-component second valve unit are configured such that said first circuit remains uninterrupted in a course between said second-system-component first valve unit and said second-system-component second valve unit during tapping and feeding back of said first treatment medium.

2. The apparatus of claim 1, wherein said treatment system comprises a second circuit, said second circuit comprising a second source for supplying a second treatment medium, a second ring line that carries said second treatment medium, a second-circuit first valve unit, a second-circuit second valve unit, wherein said second system circuit is independent of said first system circuit, and wherein said second-circuit first valve unit is configured to tap said second ring line in a controlled manner for said second treatment medium.

3. The apparatus of claim 2, wherein said second-circuit first valve unit is arranged upstream of said second-circuit second valve unit in relation to a flow direction of said second treatment medium in said second circuit.

4. The apparatus of claim 2, further comprising a control device for individually controlling said second-circuit first valve unit, said second-circuit second valve unit, said first-system-component first valve unit, said first-system-component second valve unit, said second-system-component first valve unit, and said second-system-component second valve unit to enable said first system component to be treated with said first medium and to enable said second system component to be concurrently treated with said second medium.

5. The apparatus of claim 2, wherein said first treatment medium and said second treatment medium are different.

6. The apparatus of claim 2, wherein said first treatment medium and said second treatment medium are the same.

7. The apparatus of claim 1, further comprising a first feed pipe, a second feed pipe, a first return pipe, a second return pipe, a first treatment path, and a second treatment path, wherein said first feed pipe is part of said first treatment path, wherein said second feed pipe is part of said second treatment path, wherein said first return pipe is part of said first treatment path, wherein said second return pipe is part of said second treatment path, wherein said first treatment path passes through said first system component, thereby enabling a first selected treatment medium to flow during treatment of said first system component, and wherein said second treatment path passes through said second system component, thereby enabling a second selected treatment medium to flow during treatment of said second system component, wherein said first feed pipe taps off said first selected treatment medium, wherein said second feed pipe taps off said second selected treatment medium, wherein said first return pipe returns said first selected treatment medium, and wherein said second return pipe returns said second selected treatment medium.

8. The apparatus of claim 7, wherein said first selected treatment medium and said second said first selected treatment medium are different.

9. The apparatus of claim 1, wherein said first source comprises a tank that contains an acid solution.

10. The apparatus of claim 1, wherein said first source comprises a tank that contains an alkaline solution.

11. The apparatus of claim 1, wherein said first source comprises a tank that contains water.

12. The apparatus of claim 1, wherein said first source comprises a tank that contains heated water.

13. The apparatus of claim 1, further comprising treatment path feed pipes, treatment path return pipes, a first valve module, a second valve module, a first line, and a further source that contains water containing added disinfectant, wherein said treatment path feed pipes and said treatment path return pipes are connected via said first and second valve modules to said first line, and wherein said first line is connected to said further source for enabling controlled tapping off and feeding back of said water containing added disinfectant.

14. The apparatus of claim 13, wherein said first line connected to said further source leads to a drain.

15. The apparatus of claim 1, further comprising a control device for controlling said first-system-component first valve unit and said first-system-component second valve unit to cause treatment medium fed to said first system component to be fed back to said first system circuit via said first-system-component second valve unit.

16. The apparatus of claim 1, further comprising a sensor for monitoring a type of treatment medium.

17. The apparatus of claim 1, further comprising a sensor for monitoring a quality of treatment medium.

18. The apparatus of claim 1, further comprising a heating element for heating treatment medium in at least one of said first system circuit and said first ring line.

19. The apparatus of claim 2, further comprising a treatment-media separator for ensuring separation of said first and second treatment media in component-side treatment paths.

20. The apparatus of claim 19, wherein said treatment-media separator comprises a control device, and a sensor, wherein said sensor is arranged to detect a property of treatment medium to be fed back from said first system component, and wherein said control device receives information from said sensor and, based at least in part on said information, controls said first-system-component second valve unit to cause treatment medium from said first system component to be fed back into said first ring line.

21. The apparatus of claim 20, further comprising a treatment path return pipe, wherein said sensor is arranged in said treatment path return pipe.

22. The apparatus of claim 1, wherein said first system component comprises a filling machine for bottling beverages into containers.

23. The apparatus of claim 1, wherein said first system component comprises a buffer store.

24. The apparatus of claim 1, wherein said first system component comprises a flash pasteurizing unit.

25. The apparatus of claim 1, wherein said first system component comprises a mixer unit.

* * * * *